United States Patent [19]

Siegel

[11] Patent Number: 4,980,720

[45] Date of Patent: Dec. 25, 1990

[54] DOCUMENT REPRODUCTION MACHINE WITH ENHANCED BOOK COPYING CAPABILITY

[75] Inventor: Robert P. Siegel, Penfield, N.Y.

[73] Assignee: Xerox Corporation, Stamford, Conn.

[21] Appl. No.: 526,743

[22] Filed: May 22, 1990

[51] Int. Cl.[5] ..... G03G 15/28

[52] U.S. Cl. ..... 355/233; 355/25; 355/69

[58] Field of Search ..... 355/25, 233, 232, 208, 355/214, 69

[56] References Cited

U.S. PATENT DOCUMENTS

| | | | |
|---|---|---|---|
| 3,630,612 | 12/1971 | Lehovec | 355/25 X |
| 3,775,008 | 11/1973 | Schaeffer et al. | 355/18 |
| 4,659,207 | 4/1987 | Maekawa | 355/25 X |
| 4,711,554 | 12/1987 | Nishimori | 355/25 X |
| 4,716,439 | 12/1987 | Acquaviva | 355/218 |
| 4,924,265 | 5/1990 | Partilla et al. | 355/308 X |
| 4,935,772 | 6/1990 | Wakui et al. | 355/69 X |

*Primary Examiner*—A. T. Grimley
*Assistant Examiner*—Patrick J. Stanzione

[57] ABSTRACT

A book copying mode of operation is presented which utilizes a height detector device associated with the scan mechanism to obtain a series of output signals representing changes in the distance between the scan mirror and the book pages being copied. As the book page is characteristically tend to be lifted away from the platen towards the central spine area, a distance designated as Δz is formed between the platen and the book page. A profile of this changing distance Δz is captured and electronically stored in computer memory. A controller then processes the stored signal to provide compensating signals for the errors in the projected image resulting from the changing Δz. Thus, the angular misalignment of the object image plane is corrected by causing the scan mirror to pivot during scan so as to maintain the proper orientation vis-a-vis sloping book pages. Also, the change in object conjugate caused by the increase in Δz is corrected by increasing the speed of the ½ rate mirror to shorten the relative distance between the full rate mirror and the ½ rate mirror. In one embodiment all the correction signals are generated during a pre-scan excursion with the correction signals applied by the controller during imaging scan.

10 Claims, 3 Drawing Sheets

DOCUMENT REPRODUCTION MACHINE WITH ENHANCED BOOK COPYING CAPABILITY

BACKGROUND AND INFORMATION DISCLOSURE STATEMENT

The present invention relates to a document reproduction machine such as a xerographic copier or scanner/printer and, more particularly, to such a machine having an enhanced capability for copying or scanning multi-page originals such as bound books.

In prior art reproduction machines, the copying of multi-page originals such as bound books presents a problem in that it is difficult to adequately copy the information adjacent the binding area. The "problem" is actually a series of problems all associated with the fact that pages being copied begin to lift away from the object plane (the document platen), with the lift increasing in the direction of the central binding area. This lift causes the following problems: (1) the projected image becomes increasingly out of focus; (2) the illumination becomes less than optimum in the spine area; and (3) angular misalignment of the principal projected ray at the image plane.

The above problems have been addressed in various ways in the prior art. A common "brute force" approach is to press the page or pages to be copied against the surface of a platen, U.S. Pat. No. 4,716,439 discloses one such arrangement However, as shown, for example, in FIG. 1 of the U.S. Pat. No. 4,716,839, portions of the pages adjacent the binding area still remain a short distance above the platen surface. Consequently, the information contained in these portions is out of focus on the photosensitive recording medium (and hence on the output sheet). Attempts to press the binding area closer to the platen can result in breaking the binding of the book.

Another solution to the above problem is to modify the platen to have a sloping edge portion whereby the bound part of a book is placed in a corner position so that the entire surface of the page being copied is in intimate contact with the platen surface. An example of such a system is disclosed in U.S. Pat. No. 3,775,008. These systems have several disadvantages; the magnification range is limited because of restriction on scan component movement encountering the sloping corner edge. Also operability and production are limited by the inability to employ a "split scan" scanning system which allows that both pages of a book be placed on the platen and scanned without repositioning.

According to the present invention, there is provided a scanning system which can scan documents in a normal document scan mode, but which has the added capability of scanning bound books in a book scan mode. In the book scan mode, a page height, detector mounted on the scan carriage, is activated at start of scan. In a first embodiment, the scan mechanism is moved through a pre-scan excursion whereby the detector detects and measures the deviation of the book pages from the horizontal platen plane. This deviation distance, which increases from the outer edges towards the center of the book is detected and converted into a series of analog output signals which, in turn, are used to provide corrective signals to components of the imaging system. In other words, scan speed is adjusted to develop the "true length" of the curved page, conjugate correction signals are sent to adjust for the out-of-focus and object conjugate length changes. Correction signals are also sent to the illumination lamp power supply to adjust illumination levels. A fourth correction signal is used to pivot the scan mirror so as to correct for the angular misorientation of the principal object ray. More particularly, the invention relates to an imaging system for forming an image on a photosensitive image plane of an object placed on a platen, said object having at least some areas out of physical contact with said platen by some distance $\Delta z$, the imaging system comprising: a scan mirror and scan illumination means mounted for parallel movement beneath said platen, optical detection means mounted for movement with said scan illumination means, said detection means adapted to generate a signal representative of $\Delta z$, and a microprocessor controller means for receiving said signals generated by said detector means and for generating output signals to correct for at least conjugate length changes in said imaging system created by said $\Delta z$ distance.

IN THE DRAWINGS

DESCRIPTION OF THE INVENTION

Figure 1:
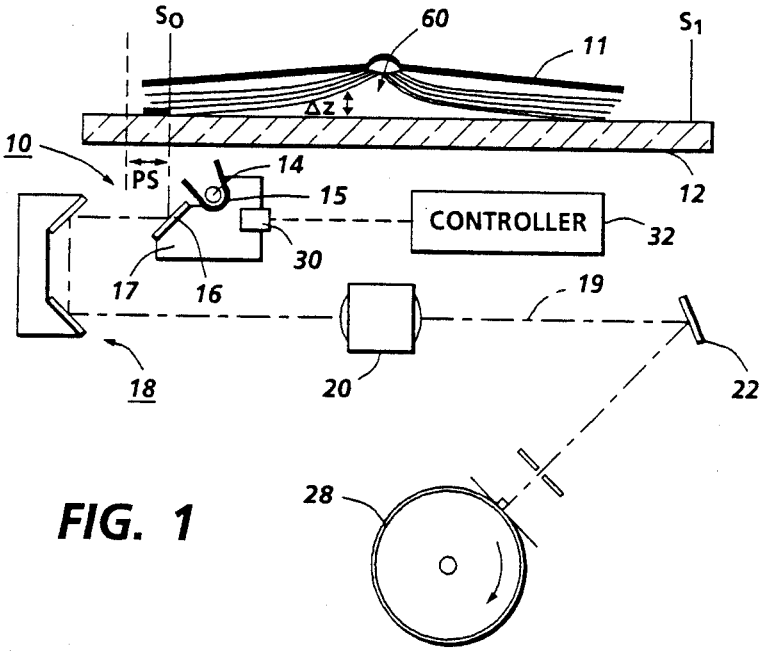
FIG. 1 illustrates, in side view, a full rate/half rate document scanning system at a start-of-scan position for a book copying mode, which incorporates the height detector of the present invention.

Referring now to FIG. 1, there is shown a full rate/-half rate scanning system which is adapted to operate in a conventional document scan mode as well as a book copying mode. A scanning system 10 includes an illumination lamp 14 and a full rate scan mirror 16. Mirror 16 is shown at the nominal 45° tilt position. Lamp 14, associated reflector 15, and mirror 16, are mounted on a scan carriage 17. Carriage 17 is adapted to move from left to right beneath the platen at the full rate (scanning) speed. A corner mirror assembly 18 is adapted to move from left to right at one-half the scanning speed to maintain a constant system conjugate. The image is reflected along optical axis 19, projected through lens 20 and reflected from mirror 22 onto the surface of a photoreceptor drum 28. Changes in magnification are accomplished by moving lens 20 towards and away from drum 28 (for reduction or enlargement, respectively) and by repositioning the mirror assembly 18 location to adjust total conjugate appropriately. The scanning mirror undergoes a pre-scan excursion to the left prior to initiation of the scan exposure cycle, with initial acceleration (and vibration damping) taking place in the pre-scan zone shown as PS. The start-of-scan position is identified as point $S_0$. The end of scan position is identified as $S_1$.

According to the present invention, also mounted on scan carriage 17 is a book edge height detector 30. The function of detector 30, during a book copying mode, is to scan the book and generate a varying output signal which represents the increase in object distance $\Delta z$ (distance from platen surface to book page) created by the book separation from the object plane. This output signal is used to provide correction signals to a controller 32 providing for focus and magnification corrections, illumination corrections and principal ray angular corrections as will be seen below.

Consider first the operation of the scanning system 10 in a conventional document scan mode (instead of a book 11 as shown, a flat document to be copied is placed on the platen). Upon a copy function being initiated, scan carriage 17 and mirror assembly 18 are moved through from a start of scan position to an end of scan position. Carriage 17 moves from left-to-right at the scanning speed while mirror assembly 18 moves from left-to-right at one-half the scan speed. The document is thus incrementally illuminated and reflected images are projected by lines 20 along optical axis 19 to form a latent image of the document at the surface of photoreceptor 28. At the end of scan, both carriage 17 and assembly 18 are returned to the start of scan position.

Figure 2:
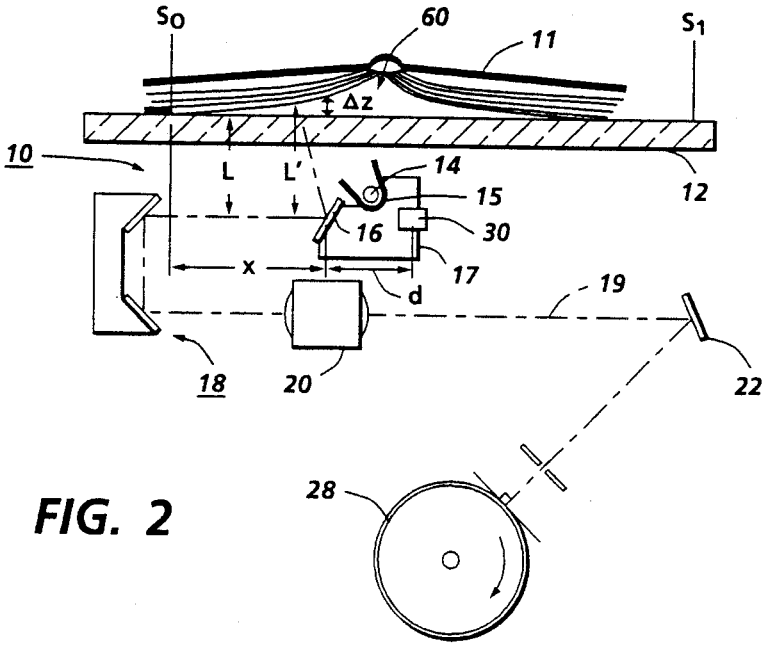
FIG. 2 illustrates the scanning system of FIG. 1 with the scan mirror nearing the central spine area of the book.

When a book copying mode is to be entered, height detector 30 is activated and the measurements of the book page deviation from the platen ($\Delta z$) is obtained either through a pre-scan operation or during real time scanning. Considering first the pre-scan operation, and with reference to FIGS. 1–5, the operator may select the book copy mode by activation of an appropriate control or switch on the control panel. Height detector 30 is energized at this time. Detector 30, in a preferred embodiment, incorporates a light emitting device such as an LED array and a light receiving device such as a CCD photosensor array (an auto-focus sensor used in cameras would be suitable) The LED array provides a constant radiation output directed upward towards the platen; the CCD array is positioned so as to receive the LED output as reflected from the pages of book 10. The CCD array is adapted to generate an output signal which represents to the change in distance from the scan mirror to the book page. In the areas where the book is lying flat on platen 12, the distance L is the distance from the scan mirror to the object platen (platen). As the book page begins to lift from the platen, the distance L′ is the sum of L plus $\Delta z$ at any particular location, e.g., as shown in FIG. 2. Thus, the output of detector 30 is representative of $\Delta z$ at any given point. This distance $\Delta z$ will be zero when the book page is flat on the platen and will rise to a maximum at the center of the book binding area. Detector 30 is shown as located in the same horizontal plane as mirror 16 although it could be vertically translated to other locations with an appropriate off-set distance used to obtain $\Delta z$.

Continuing now with the description of operation following a first, pre-scan excursion, scan carriage 17 begins to scan from point $S_o$ (mirror assembly 18 and lamp 14 can be decoupled here if desired) and scans from left-to-right. As the scan progresses, output signals from detector 30 are continuously generated and sent to position signal generation circuit 40 of (FIG. 3) where the output signals are converted into a position signal proportional to the instantaneous value of $L+\Delta z$. The output from circuit 40 is sent to controller 32 via A/D converter 42. The position signals are temporarily stored in a memory unit 44 until the entire two pages of the book are scanned. At the end of scan (position $S_1$) a complete height "profile" of the book including approximation of the slope dz/dx is then retrieved from a look-up table in memory by the controller and information extracted as to the amount of correction required to be made to the lamp 14 (for illumination correction), the scan carriage motion (for "true length" correction), to the ½ rate mirror assembly 18 position vis-a-vis the scan mirror (conjugate adjustment) and the angular position of scan mirror 16 (to correct for misorientation of the object to the image plane). Each of these corrections will be considered at this point in some detail to better appreciate the adjustments which will be made in the actual scan which follows the height profile pre-scan.

The first correction required is the scan speed adjustment. Since the scan mirror will have to rotate to ensure the correct orientation of the principal ray, the scan carriage motion must compensate by increasing its velocity by an amount which matches to angular rotation of the mirror. For an increment of scan displacement relative to a flat object $DX_f$, an additional distance given by L′ tan $\theta$ must be covered (in the same amount of time) to ensure the alignment of the mirror with the normally reflected principal ray. Thus, the instantaneous position of the carriage can be described by the equation:

$$X=X_f+L'\tan\theta$$

with $\theta$ being the instantaneous angular displacement of the book from the platen.

Referring again to FIG. 2, it will be appreciated that the distance $\Delta z$ at any given point represents an increase in the object to lens conjugate distance, and hence results in an out-of-focus and out of magnification image. In order to maintain the correct (constant) object conjugate length, and correct the focusing problems, it is necessary to move the half rate carriage forward (toward the full rate mirror 16). The motion of the half-rate carriage is given by the expression:

$$X/2+L'/2\ \mathrm{Cos}\ \theta-L/2$$

where X is the displacement of the scan carriage in the scan direction, and $\theta$ is the instantaneous angular displacement of the book from the platen. The first term is the nominal half-rate carriage motion, while the 2nd and 3rd terms are corrections to maintain magnification and focus.

Figure 3:
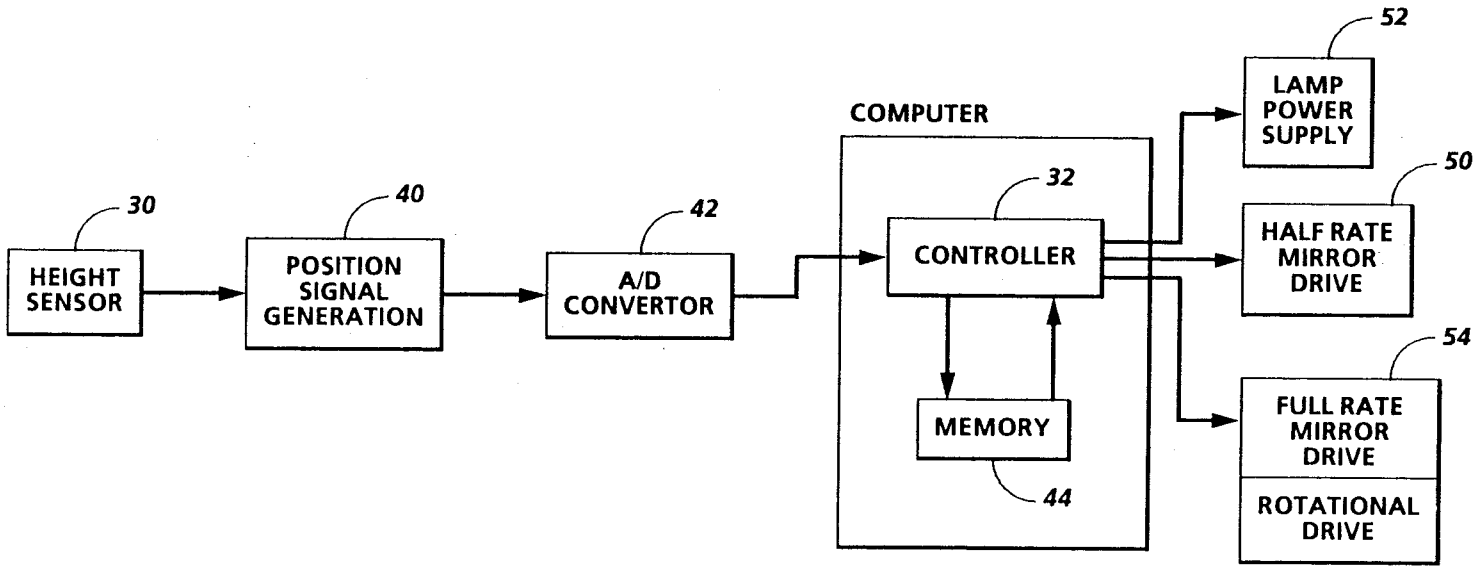
FIG. 3 is a schematic block diagram of control circuitry for generating and processing appropriate control signals during the scan cycle.

Referring to FIG. 3, controller 32 is programmed to control the drive mechanism 50 for the ½ rate mirror. Mechanism 50 can, for example, be a step motor.

Referring back to FIG. 1, and considering the necessity for an illumination correction, it is evident that as the book page is displaced from the platen, there is an effective fall off of illumination (the output of lamp 14 is no longer normally incident on the page) and the page is moved away from the optimum illumination plane. Therefore, for some systems it may be necessary to gradually increase, and then decrease the lamp power output during the actual scan. Controller 32 is programmed to provide the varying illumination output by sending appropriate signals to lamp 14 power supply 52.

The fourth correction required is to correct for the angular misorientation of the object to the image plane. Referring again to FIG. 1, it will be apparent that if the scan mirror 16 were to maintain the tilt position shown, the principal rays reflected from the book pages would become increasingly misoriented resulting in a non-perpendicular imaging of that ray at the surface of drum 28. Controller 32 is, therefore, programmed to cause scan mirror 16 to rotate by sending signals to appropriate rotational means 54 which again can be a stepped motor. During the subsequent scan mode, the principal ray is maintained in a normal orientation to the ½ rate mirror. The pivot motions undergone by mirror 16 will be described in the following description of the scan mode which follows the pre-scan mode.

Continuing with the description of the book copying mode, following the pre-scan height profiling step, the scan components are returned to the start-of-scan position shown in FIG. 1. As scanning begins and until the back page begins to lift from the platen, no corrections are made by controller 32. However, and as shown in FIG. 2, the scan components have moved to the position shown and two of the three corrective actions required are evident. The controller has sent signals to mirror 18 drive mechanism 50 increasing the speed of mirror assembly 18 so as to adjust the object conjugate for the additional distance $\Delta z$ from platen to book page (in accordance with equation (1). Thus, from the mirror assembly 18 to lens distance of X shown in FIG. 1, the distance has been reduced to a $(X-\Delta z/2)$. Also, the position of mirror 16 as compared to its tilt angle in FIG. 1 has been to pivot CCW about its y axis from a nominal 45° to $45°+\theta/2$ by appropriate signals from controller 32 to rotational drive 54. Finally, and although not evident in the figure, the illumination output from lamp 14 has been increased by the output signals from the controller to lamp power supply 52.

Figure 4:
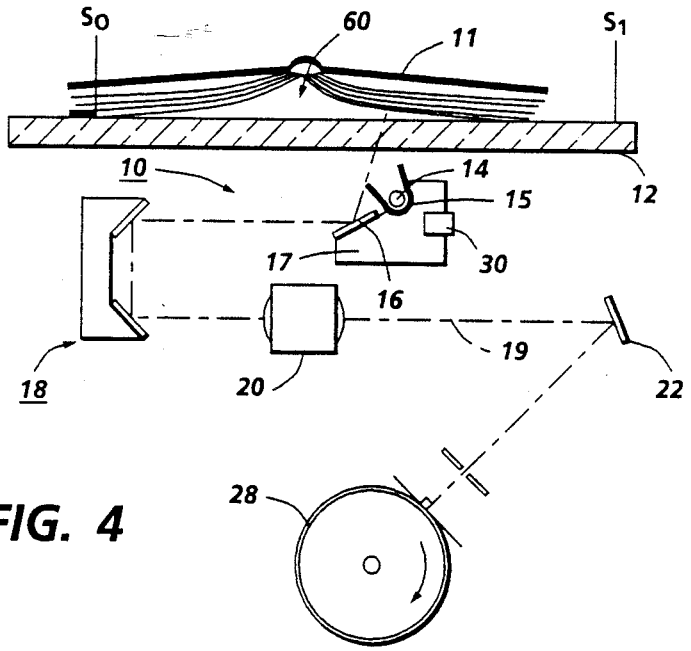
FIG. 4 shows the scanning system of FIG. 1 with the scan means intermediate the central space area and the outer edge of a book.
Figure 5:
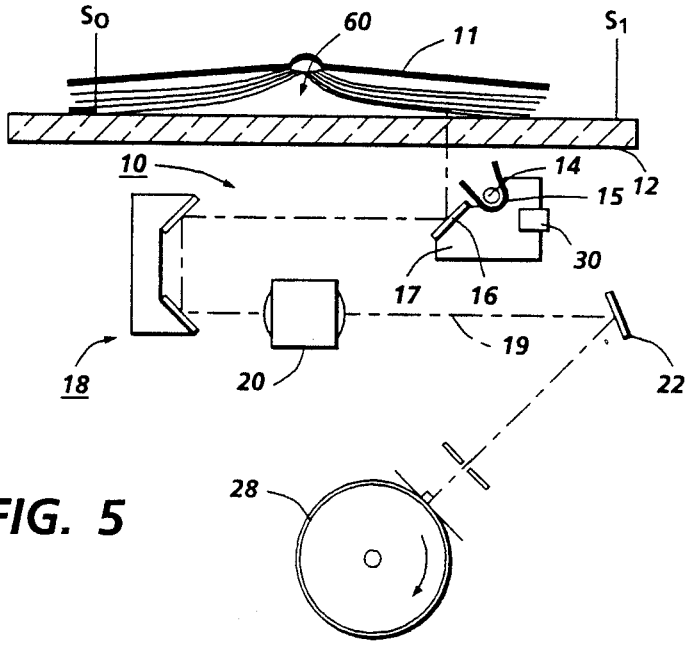
FIG. 5 shows a scanning system of FIG. 1 at the end of scan position.

As the scan progresses from the position shown in FIG. 2 to the position shown in FIG. 4, the scan mirror 16 completes the scan of the first page of the book and progresses through the spine area 60. In order to be properly oriented to scan the second page of the book, the mirror must be rotated through an angle approaching 90° since the principal ray will be reflected from the opposite direction for the second page. The rotation can be accomplished by conventional motor drive. The optimum time to accomplish the 90° rotation is during the time the scan progresses through spine area 60. Since there is rarely any information in this area, a dead band deletion is accomplished during the scan mirror rotation through this area. During the transition from the scan component position of FIG. 2 to FIG. 4, the increase in speed of the mirror assembly 18 reaches its maximum at the area 60 and then begins to gradually decrease. Similarly, the illumination increase rises to a maximum at space 60 and then gradually decreases at end of scan to the same level as at the start of scan.

To summarize the above book copy mode, the book height profile is "mapped" by scanning the book while activating the height detector device. Outputs from the height detector are processed, stored in memory and then retrieved by a controller which uses the stored signals to generate correction signals during the subsequent imaging mode. The correction signals are applied, in real time, to maintain true length by varying the scan spaced, constant object conjugate distance (by increasing speed of the ½ rate carriage); varying the output of lamp 15 and changing inclination of scan mirror 16 vis-a-vis the object plane.

From the above description, it is seen that the pre-scan mode offers maximum functionality. The microprocessor controller is fully programmed to accept inputs relating to size of copy paper selected, magnification, collation and simplex/duplex modes. All of these ancillary inputs can be entered following the pre-scan, but before the imaging scan begins. Also, at this time, an appropriate split scan algorithm can be entered to enable each page of the book to be copied onto an individual sheet, either in a simplex or a duplex mode. The split scan technique would use the height sensing device to determine the spine area 60. Once the scan mirror is located at the central point a dual scan is implemented, once in each direction as split scanning is now done or book copying without height correction. This mode would simplify the height correction motion required and enable all the benefits that split scanning currently offers, e.g., auto-reduction, duplexing, etc. Details of a split scan technique which can be implemented in the present invention by appropriate processing of the controller are provided in U.S. Pat. No. 4,658,207 whose contents are hereby incorporated by reference.

The main disadvantage with the above-described pre-scan mode is the loss of process time (the time taken to accomplish the pre-scan). An alternative method is to enable the detector 30 during the actual imaging scan obtained the height profile "on the fly". For this technique, the detector must be mounted on the front of the carriage 17 (in the direction of scan) as shown in FIG. 2 by some distanced (For the pre-scan mode, the detector may be located in other positions, for example, nearer the mirror). The detector must be positioned far enough in front to provide sufficient time for the height profile information to be processed and, under the control of controller 32, to be fed back into the imaging system components to provide the necessary corrections. The sensor portion of detector 30 must, for this mode, be able to discriminate between reflected light from the LED source and reflected light from lamp 14. For some systems, it may be possible to use the reflected lamp light alone and dispense with the need for an independent light emitting source for the real time scan mode. This would require the sensor to be repositioned so as to be in the path of the reflected light from the lamp 14. This mode, however, will be less versatile compared to the pre-scan since copy paper size, split-scan and mag functions would rely on manual positioning of the spine because there would be insufficient time to make paper feed decisions once the scan reaches the book spine (area 60).

While the present invention finds greatest utility in book copying its principles are applicable to other types of copying, e.g., 3 dimensional objects (as long as the height is limited and there is a constant at each scan position ($d_z/d_y=0$), and heavily curled or folded documents.

While the invention has been described with reference to the structure disclosed, it will be appreciated that numerous changes and modifications are likely to occur to those skilled in the art, and it is intended to cover all changes and modifications which fall within the true spirit and scope of the invention.

I claim:

1. An imaging system for forming an image on a photosensitive image plane of an object placed on a platen, said object having at least some areas out of physical contact with said platen by some distance $\Delta z$, the imaging system comprising:

a scan mirror and scan illumination means mounted for parallel movement beneath said platen, optical detection means mounted for movement with said scan illumination means, said detection means adapted to generate a signal representative of $\Delta z$, and microprocessor controller means for receiving said signals generated by said detector means and for generating output signals to correct for at least conjugate length changes in said imaging system created by said Δz distance.

2. The imaging system of claim 1 wherein said object is a book placed face down on said platen, and Δz represents the instantaneous distance between the pages of the book and the platen during scan.

3. The system of claim 1 wherein said scan illumination means includes an illumination lamp, with associated power supply, a full rate scan mirror with associated pivot mechanism, a ½ rate mirror assembly with associated independent drive mechanism, and a projection lens, all of said components aligned along an optical axis, and wherein said controller means, in response to said detector output signals, generates and sends correction signals to at least said scan mirror pivot mechanism during an imaging scan, said correction signals causing said scan mirror to rotate on its y axis through an angle which maintains a principal ray reflected from said mirror in a normal orientation with said ½ rate mirror assembly.

4. The system of claim 3 where the scan carriage position and speed can be varied in response to angular height variation of the object surface.

5. The system of claim 3 wherein said controller means generates additional correction signals applied to said mirror assembly drive mechanism so as to maintain a constant object conjugate by compensating for the conjugate increase created by said Δz distance.

6. The system of claim 5 wherein said controller means generates additional correction signals applied to said lamp power supply so as to vary the lamp output in response to Δz distance changes.

7. The system of claim 1 wherein said optical detection means includes at least a sensor array.

8. The system of claim 7 wherein, said optical detection means further includes a light emitting source.

9. The system of claim 7 wherein the sensor array is illuminated by light from said illumination means during a copy scan.

10. A method for copying a book placed open and lying on an object platen, at least some of the pages lying adjacent to said platen being separated from said palten surface by a distance Δz, Δz increasing towards the central spine area of the book including the steps of, scanning said book in a non-imaging mode and generating a stream of data signals representative of the changes in distance Δz from start of scan to end of scan, storing said signals during said pre-scan interval, analyzing said stored signals by a controller means and generating a plurality of correction signals which are applied to system scan components during copy scan cycle to correct for at least object conjugate changes and angular misalignment caused by changes in the value of Δz through scan.

* * * * *